US005572786A

United States Patent [19]

Rensch

[11] Patent Number: 5,572,786

[45] Date of Patent: Nov. 12, 1996

[54] METHOD FOR HOLDING A WORKPIECE BY VACUUM

[75] Inventor: Louis A. Rensch, Davenport, Iowa

[73] Assignee: Aluminum Company of America, Pittsburgh, Pa.

[21] Appl. No.: 526,298

[22] Filed: Sep. 11, 1995

[51] Int. Cl.[6] ..... B25B 11/00

[52] U.S. Cl. ..... 29/559; 269/21

[58] Field of Search ..... 269/20, 21, 329; 294/64.1, 64.2; 279/3; 408/76; 248/362, 363; 451/388; 29/559

[56] References Cited

U.S. PATENT DOCUMENTS

| | | | |
|---|---|---|---|
| 3,294,392 | 12/1966 | Dunham | 451/388 |
| 3,598,006 | 8/1971 | Gerber et al. | 269/21 |
| 3,652,075 | 3/1972 | Thompson | 269/21 |
| 3,765,289 | 10/1973 | Gerber et al. | 269/21 |
| 5,454,552 | 10/1995 | Boiteux | 269/21 |
| 5,465,951 | 11/1995 | Burt et al. | 269/21 |
| 5,493,767 | 2/1996 | Susnjana | 269/21 |

*Primary Examiner*—Robert C. Watson
*Attorney, Agent, or Firm*—David J. Hill; Elroy Strickland

[57] ABSTRACT

A method is disclosed for holding a workpiece having an upper surface, a lower surface and a peripheral edge, in order to facilitate machining or working thereof. According to this method, a bed is provided that is adapted to support the workpiece, said bed having a nonplanar supporting surface so that when the workpiece is supported thereby, a plurality of evacuation spaces are formed between the lower surface of the workpiece and the nonplanar surface of the bed. The bed is also provided with a plurality of vacuum ports that extend therethrough, which ports are in fluid communication with the evacuation spaces so that at least one port communicates with each such space. In the practice of the method a continuous flexible tape is secured to and along the peripheral edge of the workpiece, which tape has a continuous flexible lip portion that curves generally outwardly from the edge of the workpiece. The workpiece with the tape secured thereto is placed on the supporting surface of the bed so as to form a plurality of evacuation spaces between the lower surface of the workpiece and the nonplanar surface of the bed. Vacuum ports in the bed that are located outside the periphery of the workpiece are blocked or closed, and a vacuum is pulled through the open vacuum ports and evacuation spaces beneath the workpiece so as to hold the workpiece on the bed. In the practice of this method, the lip portion of the tape will seat on the surface of the bed so as to form a seal between the tape and the surface of the bed at the periphery of the workpiece.

18 Claims, 2 Drawing Sheets

METHOD FOR HOLDING A WORKPIECE BY VACUUM

FIELD OF THE INVENTION

This invention relates generally to the holding of workpieces on the bed of a machine or other surface to facilitate machining or other working thereof or for other purposes. More particularly, the invention relates to the holding of such workpieces on a work bed by the creation of a partial vacuum between the workpiece and the bed. The invention is suitable for uses including the holding of large workpieces of metal plate on the work bed of a milling or other metalworking machine.

BACKGROUND AND DESCRIPTION OF THE PRIOR ART

Vices and clamps are well-known devices for use in holding workpieces in place on the work bed of a machine to facilitate machining or other working thereof. Such mechanical devices are not always suitable, however, for holding workpieces, especially when the pieces to be held are large or cumbersome. Metallic workpieces that are capable of magnetic attraction may also be held in place magnetically, and for workpieces that are not capable of such attraction, vacuum chucks and the like may be employed to hold them. Such vacuum holding devices typically include a means for creating an evacuation space between the workpiece or a portion thereof and the surface of the chuck or the bed on which the workpiece is to be held. Such means usually includes a sealing gasket that is provided on the chuck or work bed around or beneath the workpiece or a major portion thereof so that a partial vacuum may be generated in the evacuation space between at least a portion of the workpiece and the chuck or bed to hold the workpiece in place thereon.

When a vacuum chuck or work bed is designed to accommodate a particular workpiece of a specific size and shape, as opposed to workpieces of a variety of sizes and shapes, it is known to place the sealing gasket on the chuck or bed around the periphery of the workpiece. Thus, for example, U.S. Pat. No. 2,807,180 of Adams describes a vacuum holding chuck for a workpiece, such as a jet engine compressor wheel, that has an annular flange. The device includes an adjustable ring with a rubber sealing band on its inside surface. The ring and sealing band are placed around the outside of the annular flange of the workpiece, and a locating disk of the chuck is placed inside the flange. The cavity between the disk and the adjustable ring is evacuated to hold the flanged workpiece in place on the chuck.

U.S. Pat. No. 3,233,887 of Dunham describes a vacuum-actuated chuck that provides for accommodation of a variety of workpiece shapes by utilizing a customized chucking or surface plate that is made to conform with the shape of each particular workpiece. The chuck of Dunham includes a base having a plurality of vacuum channels surrounded by a peripheral sealing groove which contains an O-ring. The customized chucking or surface plate fits together with the base and cooperates with the vacuum channels in the base to form a vacuum chamber. In another embodiment of the method and apparatus of Dunham, the surface plate is formed of a porous material, which is masked, as by a plastic film, so as to outline the shape of the workpiece to be held. U.S. Pat. No. 3,294,393, also of Dunham, describes a similar vacuum chuck which includes a porous surface. The workpiece to be held is placed on the porous surface, and a plastic film is placed over the workpiece and the porous surface. Portions of the film are then removed from the part of the workpiece to be machined or otherwise worked. However, many cutting, milling and other working machines that are required to operate on workpieces of a variety of shapes, sizes and configurations may not readily lend themselves to the creation of a specialized sealing plate for each shape of workpiece, or to the covering of the entire workpiece with a plastic film. Vacuum chucks and other similar holding devices for such machines, therefore, have typically employed sealing gaskets that are placed beneath the workpiece on the chuck or work bed. Thus, for example, U.S. Pat. No. 2,730,370 of Brewster describes a work-holding chuck that includes a circumferential groove, or a plurality of such grooves concentrically disposed with respect to each other, and one or more air conduits through the chuck body within the circle bounded by each groove. On the side of each groove nearest the center of the chuck is a lip of particular shape that acts to retain an O-ring that is placed in the groove. The O-ring is selected to be of a size that will be retained by the circumferential groove into which it is placed in such fashion that a portion of it will extend above the chuck surface. When a workpiece is placed on the chuck body, air is withdrawn through the air conduits to pull the workpiece towards the chuck surface, thereby compressing the O-ring or -rings to seal the vacuum holding configuration underneath the workpiece and within the compressed O-ring or -rings.

U.S. Pat. No. 2,782,574 of Copold describes a vacuum work holder comprised of a pair of plates that are joined together. On the upper surface of the upper plate are arranged a plurality of circular grooves or slots, into each of which is positioned a resilient or elastomeric ring. A vacuum port inside each of the circular grooves extends through the upper plate. The lower plate is attached to the upper plate with a gasket disposed therebetween, and a vacuum pump is connected to the side of the assembly. When a planar workpiece to be held is placed on the upper plate, the vacuum ports outside the workpiece are closed off, and the vacuum pump is activated to evacuate the circular evacuation spaces beneath the workpiece and hold the workpiece on the upper plate.

U.S. Pat. No. 4,856,766 of Huberts describes another vacuum apparatus for holding workpieces such as silicon wafers or optically-readable disks. The apparatus consists of a work face having a plurality of elastic supports such as may be obtained if the work face is covered by the type of material that is used to cover table tennis paddles. A sealing gasket surrounds the work face, and a vacuum duct is provided which is in communication with the space between the elastic supports on the work face. The gasket includes an axially-movable lip that deforms against the lower surface of a workpiece that is placed on the work face when the vacuum space under the workpiece and between the elastic supports is evacuated.

U.S. Pat. No. 3,652,075 of Thompson is directed to a vacuum chuck having a work face which is provided with a plurality of parallel and intersecting grooves that form a rectangular grid pattern. The grooves are designed to receive an elongated, closed-cell rubber seal, which is discontinuous so that it may be placed in various different grooves to define a continuous seal in the work face of the chuck and under the workpiece, with the area enclosed by the seal being dependent on the size of the workpiece to be held by the chuck. Passages are provided in the chuck to communicate with the grooves in the work face. Those which are in communication with grooves outside the seal around the workpiece are closed off, while those inside the seal are left open for transmission of a vacuum to the area enclosed by the seal under the workpiece. Although the method of Thompson can accommodate workpieces of varying sizes and shapes, it requires that the work bed or chuck be prepared for each different shape or size of workpiece before the workpiece can be worked thereon. For large workpieces and those of intricate shape, preparation of the bed or chuck can take a considerable amount of time. During this time of preparation, the work bed or chuck cannot be used for its intended purpose, and is therefore unproductive. Because of this requirement for considerable set-up time for the work bed before each different size and shape of workpiece can be accommodated, the method of Thompson may not be suitable where varying sizes or shapes of workpieces may frequently be encountered. In addition, although the parallel and intersecting grooves in the bed of Thompson permit the establishment of a vacuum seal between the bed and the workpiece that extends near to the periphery of the workpiece, this method does not permit the vacuum holding force to be established at the periphery of the workpiece.

U.S. Pat. No. 5,141,212 of Beeding describes a vacuum chuck for supporting a workpiece during cutting thereof by a machine tool. The chuck includes a support plate that is provided with a plurality of holes which are in communication with one or more vacuum plenums in a base therebelow. The plenums can be selectively connected to or isolated from the vacuum source, depending on the size of the workpiece to be cut, so as to evacuate the plenum or plenums under the workpiece, but not those outside its boundary. A sheet of material such as particle board, also provided with a plurality of holes, is positioned atop the support plate, with the holes in the support plate and the particle board in alignment. A sheet of open cellfoam is laid atop the particle board and the workpiece to be cut is placed atop the cellfoam. vacuum is applied, which is channeled from the vacuum plenum or plenums under the workpiece, through the holes in the support plate and the particle board, and through the cellfoam to the workpiece. The foam does not seal against the workpiece, but as the plenum or plenums under the workpiece are evacuated, the foam compresses and its coefficient of friction increases so that the workpiece is unable to slide thereon. It would seem that the method and apparatus of Beeding would not permit the establishment of a strong vacuum force to hold the workpiece in place, since no seal is provided between the workpiece and the vacuum source. However, many metalworking and other operations require that a strong holding force be established. Some such operations also require that high-powered suction nozzles be employed to remove cuttings or chips that are generated during working, and such nozzles may generate such powerful suction forces, especially at the edges of relatively thin workpieces, that the vacuum forces holding the workpieces may be overcome, and the workpieces may be dislodged from the chuck or work bed. Even those methods that may be capable of establishing a seal near the periphery of a workpiece, such as that of Thompson, may not be able to provide a seal sufficient to hold against strong suction forces. Therefore, it is frequently important that a vacuum holding method and apparatus operate by establishing a vacuum holding force against the workpiece even to the outer edges or periphery. However, as has been seen, known methods for establishing a vacuum holding force around the periphery of a workpiece either require that a customized work surface or sealing plate be provided for each size and shape of workpiece, or that the entire workpiece be covered by a sealing film. In addition, as has been illustrated, most of the known vacuum chucks, including those that operate by establishing a vacuum holding force against only a portion of the workpiece, are provided with precisely located and machined grooves or other features of the work bed. These features may be expensive to provide, and they may be subject to damage with repeated use, especially where large or massive workpieces are involved.

In the production of aircraft wing panels, for, example, it is necessary to hold large workpieces of metal plate, such as aluminum alloy planks, on the work bed of a milling machine that is used to form the planks into the desired shapes. Such workpieces may range from 150–1260 inches long by 40–130 inches wide, and they may weigh as much as 15000 pounds. Consequently, these workpieces are typically quite large and cumbersome, but they can vary considerably in shape and size.

In the operation of such a milling machine, the workpiece is held on a work bed of fixed height, and a milling cutter, making successive passes across the workpiece, mills the plank into the general configuration of an aircraft wing panel. Despite the large size of the workpieces, the milling machine may be utilized to mill the peripheral edges of the wing panels down to a thickness of less than one-half inch. As the milling or cutting operation is carried out, a powerful suction device, which is carried by the milling cutter head, operates to remove the cuttings or debris produced by the milling operation. The milling machine with which the inventor is most familiar, an Ingersol Precision Milling Machine manufactured by the Ingersol Corporation of Rockford, Ill., uses a vacuum holding method that is somewhat similar to the method of Thompson described herein to hold the workpieces on the work bed. Such method requires that a series of intersecting grooves be provided in the work bed, which are in fluid communication with a series of vacuum ports that extend through the bed. Prior to the milling of a wing plank of a particular size and shape, considerable time is required to prepare the bed for use by placing one or more elongated, closed-cell rubber seals into the various different grooves beneath the workpiece and as close to its peripheral edges as the orientation of the intersecting grooves permits. Despite these efforts, however, the suction device carried by the milling cutter head sometimes overcomes the vacuum holding force that is established between the workpiece and the bed, and it pulls the workpiece from the bed. Furthermore, the extensive time required to prepare the bed for each wing panel leaves the bed unproductive for its intended use for hours at a time.

It would be desirable, therefore, if a method could be provided for establishing a strong vacuum holding force between a workpiece and a work bed which extends to the periphery of the workpiece, regardless of the size or the shape of the workpiece. It would also be desirable if a method could be provided for establishing a seal between a workpiece and a work bed that would permit the provision of such vacuum holding force without requiring that any preparatory operations be performed on the bed. It would also be desirable if a method could be provided for establishing a strong force to hold a workpiece on a work bed without requiring a precise and complicated arrangement of grooves and/or other surface features on the work bed.

OBJECTS AND ADVANTAGES OF THE INVENTION

Accordingly, it is an object of the invention claimed herein to provide a method for holding a workpiece on a work bed by applying a vacuum holding force between the bed and the entire workpiece. It is another object of the invention claimed herein to provide such a method that does not require that any preparatory operations be performed on the bed. It is yet another object of the invention to provide a method for establishing a strong force to hold a workpiece on a work bed that is suitable for use with workpieces of a variety of sizes and shapes. It is still another object of the invention to provide such a method that may be implemented without requiring a precise and complicated arrangement of grooves and/or other surface features on the work bed. Additional objects and advantages of this invention will become apparent from an examination of the drawings and the ensuing description.

SUMMARY OF THE INVENTION

A method is disclosed for holding a workpiece having an upper surface, a lower surface and a peripheral edge, in order to facilitate machining or working thereof. According to this method, a bed is provided that is adapted to support the workpiece, said bed having a nonplanar supporting surface so that when the workpiece is supported thereby, a plurality of evacuation spaces are formed between the lower surface of the workpiece and the nonplanar surface of the bed. The bed is also provided with a plurality of vacuum ports that extend therethrough, which ports are in fluid communication with the evacuation spaces so that at least one port communicates with each such space. In the practice of the method, a continuous flexible tape is secured to and along the peripheral edge of the workpiece, which tape has a continuous flexible lip portion that curves generally outwardly from the edge of the workpiece. The workpiece with the tape secured thereto is placed on the supporting surface of the bed so as to form a plurality of evacuation spaces between the lower surface of the workpiece and the nonplanar surface of the bed. Vacuum ports in the bed that are located outside the periphery of the workpiece are blocked or closed, and a vacuum is pulled through the open vacuum ports and evacuation spaces beneath the workpiece so as to hold the workpiece on the bed. In the practice of this method, the lip portion of the tape will seat on the surface of the bed so as to form a seal between the tape and the surface of the bed at the periphery of the workpiece.

In order to facilitate an understanding of the invention, several embodiments of the invention are illustrated in the drawings and a detailed description of the preferred embodiments follows. It is not intended, however, that the invention be limited to the particular embodiments described or to use in connection with the apparatus shown. Various changes are contemplated such as would ordinarily occur to one skilled in the art to which the invention relates.

DESCRIPTION OF THE PREFERRED EMBODIMENTS OF THE INVENTION

Figure 1:
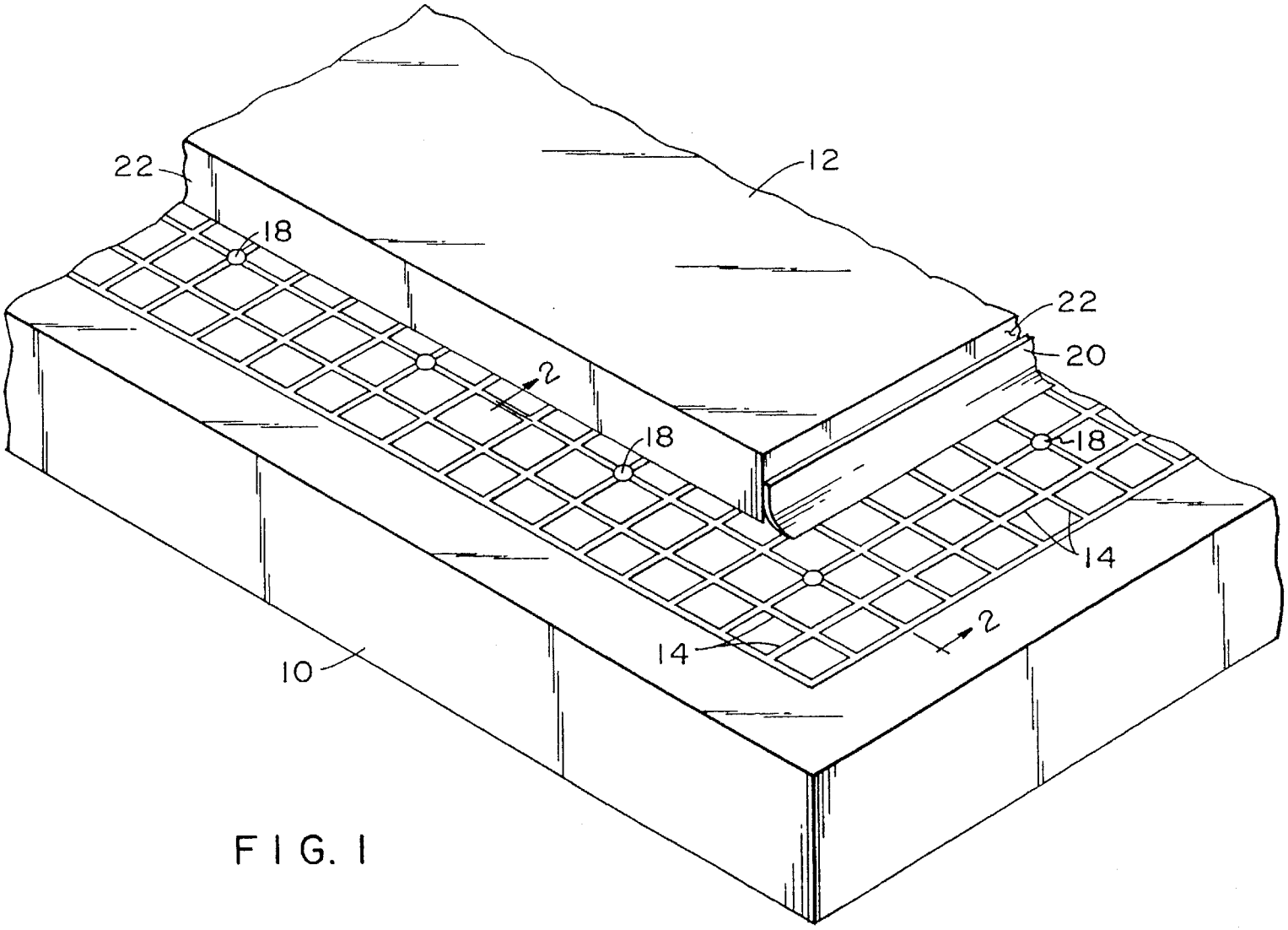
FIG. 1 is a partial perspective view of a workpiece on a work bed that is designed to operate in accordance with the principles of the invention, showing the flexible continuous tape that is utilized therewith on a portion of the peripheral edge of the workpiece.
Figure 2:
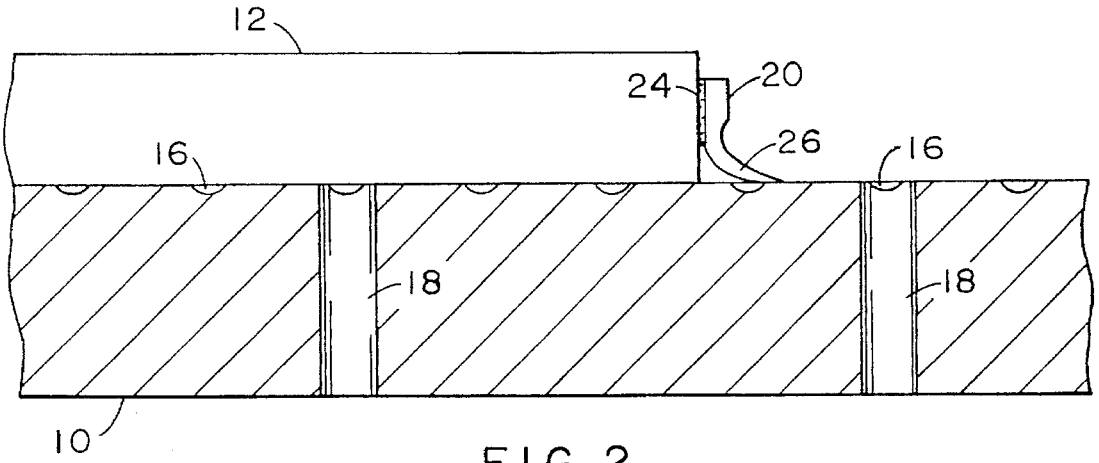
FIG. 2 is a cross-sectional view of the bed and workpiece of FIG. 1, taken along the line 2—2 of FIG. 1.

Referring now to the drawings, FIGS. 1 and 2 illustrate the operation of the invention on a milling machine that is designed to mill aluminum alloy planks into wing panels. As shown therein, work bed 10 is provided for supporting a workpiece such as plank 12. Bed 10 is provided with a nonplanar supporting surface which includes a series of intersecting grooves 14. As used herein, the term "nonplanar supporting surface" means a surface that is not continuously planar, but is capable of supporting the workpiece in such fashion that a plurality of evacuation spaces, such as spaces 16 (see FIG. 2), are formed between the lower surface of the workpiece and the nonplanar surface of the bed. The presently preferred embodiment of such surface for use in connection with the invention is the grooved surface illustrated in FIGS. 1 and 2. However, alternative configurations are also contemplated by the invention, and in fact, the particular configuration of the surface of the work bed is not critical. The work bed could alternatively be provided with a series of raised ridges on which the workpiece may be supported, or it could be provided with a plurality of depressions of circular or other convenient shape formed in an otherwise planar supporting surface.

Preferably the grooves are arranged in a grid pattern such that a group of parallel grooves are intersected at right angles by another similar group of parallel grooves. Such a grid pattern will operate to space the grooves evenly across the bed for a purpose that will be explained hereinafter. However, any convenient arrangement of grooves or nonplanar surface features may be employed, so long as the workpiece will by supported by the surface of the bed and evacuation spaces are formed between the surface of the bed and the lower surface of the workpiece. Good results have been obtained in the operation of the invention in connection with a milling machine for aircraft wing panels when the groove pattern of FIG. 1 is employed such that adjacent grooves in the groups are spaced about four inches apart.

The bed is also provided with a plurality of vacuum ports 18 that extend therethrough, which ports are in fluid communication with evacuation spaces 16 by means of grooves 14 so that at least one port communicates with each such space. As shown in FIG. 1, vacuum ports are preferably located at intersections of grooves 14, although they need not be located at each such intersection. The location of the vacuum ports will depend somewhat on the sizes of the workpieces that are anticipated to be worked on the bed. The vacuum ports are connected through suitable piping, fittings and valves (not shown), to one or more vacuum pumps (also not shown), in a known and conventional manner.

In the practice of the invention, a continuous flexible tape, such as tape 20 is secured to and along the peripheral edge 22 of the workpiece. Preferably, the tape is attached to the workpiece before it is placed on the bed, so that the bed is not unduly occupied in preparation for working of the workpiece. Although FIG. 1 shows the tape secured to only one portion or side of peripheral edge 22 of workpiece 12, in the practice of the invention the tape will be secured along the entire periphery of the workpiece.

The tape is comprised of a non-porous elastomeric material such as rubber or the like. Preferably, the tape has an adhesive backing, such as backing 24, to facilitate its attachment to and along the periphery of the workpiece, although other means of attachment can be used. Backing 24 is somewhat exaggerated in size, as shown in the drawings. Its thickness is preferably that of a thin film. Furthermore, backing 24 is preferably provided by its manufacturer with a paper strip (not shown) that serves to protect the adhesive backing. Such a paper strip is intended to be removed from the backing before the tape is applied to the peripheral edge of the workpiece.

Figure 3:
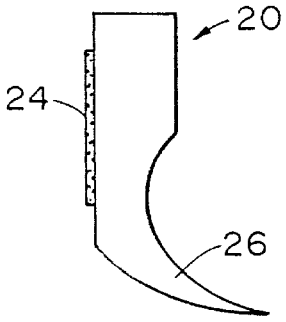
FIG. 3 is an enlarged end elevation view of the flexible continuous tape shown in FIG. 1.

As shown best in FIGS. 2 and 3, tape 20 has a continuous flexible lip portion 26 that curves generally outwardly from the edge of the workpiece. In the practice of the invention, the tape cooperates with the nonplanar features of the bed to permit the formation of a plurality of evacuation spaces between the lower surface of the workpiece and the nonplanar surface of the bed. When the workpiece with the tape secured thereto is placed on the supporting surface of the bed, a plurality of evacuation spaces are formed between the lower surface of the workpiece and the nonplanar surface of the bed, bounded by the tape on the periphery of the workpiece. As shown in FIG. 2, grooves 14 are preferably relatively shallow and flexible lip portion 26 is preferably tapered, so as to permit the lip portion of tape 20 to seal across the grooves.

The grooves that are provided in connection with the invention need not be as deep as those utilized by the method of Thompson, since the seal is established across them and not within them. It is preferred, therefore, that the depth of the grooves be no greater than the length of the lip portion of the tape. Good results have also been obtained when the grooves are arc-shaped in cross-section, with a diameter of the arc of about one inch, and a groove depth of about 1/32 inch. The lip portion should also be thin in order to provide sufficient flexibility, preferably on the order of about one-eighth inch at its point of attachment to the body of the tape, when the grooves are sized as set forth above.

In the practice of the invention, vacuum ports in the bed that are located outside the periphery of the workpiece, such as those shown in FIG. 1, are blocked or closed, and a vacuum is pulled through the open vacuum ports and evacuation spaces in the grooves beneath the workpiece so as to hold the workpiece on the bed. As the vacuum pump or pumps are activated to evacuate air from the evacuation spaces, the lip portion of the tape will seat on the supporting surface of the bed so as to form a seal between the tape and the surface of the bed at the periphery of the workpiece. Upon activation of the vacuum pump, a partial vacuum is created in the evacuation spaces between the workpiece and the bed. In such circumstance, the air pressure outside the spaces is much greater than the pressure within, whereby the workpiece will be held in place on the work bed.

Preferably, grooves 14 extend to and beyond the peripheral edge of the workpiece, so that communication of the vacuum ports beneath the workpiece with the grooves will permit the creation of evacuation spaces that extend to the periphery of the workpiece where the tape is attached. This will insure that the vacuum holding force is strong even at the periphery of the workpiece, so that the workpiece will not be dislodged by operation of a suction device that is employed to remove debris or milling chips. However, because the lower surface of the workpiece will not mate perfectly with the portion of the supporting surface of the bed that is in contact therewith, it is believed that the entire area under the workpiece will contribute to the establishment of the vacuum holding force. In other words, it is believed that there will be leakage between the evacuation spaces 16, such that the evacuation of air through the vacuum ports will create a partial vacuum beneath the entire surface of the workpiece that is bounded by the flexible tape. This will contribute to the establishment of a strong holding force to keep the workpiece in place on the bed.

Figure 4:
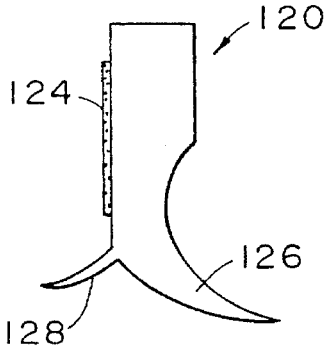
FIG. 4 is an enlarged end elevation view of an alternative embodiment of the continuous tape that may be utilized in connection with the invention.

Another embodiment of the tape that may be utilized in the practice of the invention is shown in cross-section in FIG. 4. As shown therein, continuous flexible tape 120 is adapted to be secured to and along the peripheral edge 22 of the workpiece. The tape is comprised of a non-porous elastomeric material such as rubber or the like. Preferably, the tape has an adhesive backing, such as backing 124, to facilitate its attachment to and along the periphery of the workpiece, although other means of attachment can be used. Backing 124 is somewhat exaggerated in size, as shown in FIG. 4. Its thickness is preferably that of a thin film. Furthermore, backing 124 is preferably provided by its manufacturer with a paper strip (not shown) that serves to protect the adhesive backing. Such a paper strip is intended to be removed from the backing before the tape is applied to the peripheral edge of the workpiece.

Tape 120 is provided with a pair of continuous flexible lip portions. First lip portion 126 curves generally outwardly from the edge of the workpiece, and second lip portion 128 curves generally inwardly from the edge of the workpiece. In the operation of the invention, first lip portion 126 operates much as lip portion 26 of tape 20. However, second lip portion 128 is adapted to be disposed between the workpiece and the supporting surface of bed 10, when the workpiece with the tape secured thereto is placed on the supporting surface of the bed. Second lip portion 128 will therefore cooperate with the first lip portion to form the seal when a vacuum is pulled.

In the practice of the invention, tape 120 cooperates with the nonplanar features of the bed to permit the formation of a plurality of evacuation spaces between the lower surface of the workpiece and the nonplanar surface of the bed. When the workpiece with the tape secured thereto is placed on the supporting surface of the bed, a plurality of evacuation spaces are formed between the lower surface of the workpiece and the nonplanar surface of the bed, bounded by the tape on the periphery of the workpiece. Preferably, grooves 14 are preferably relatively shallow and first flexible lip portion 126 is preferably tapered, so as to permit the first lip portion of tape 120 to seal across the grooves. It is also preferred that the depth of the grooves be no greater than the length of the first lip portion 126 of the tape. Good results have also been obtained when the grooves are arc-shaped in cross-section, with a diameter of the arc of about one inch, and a groove depth of about 1/32 inch. The first lip portion should also be thin in order to provide sufficient flexibility, preferably on the order of about one-eighth inch at its point of attachment to the body of the tape, when the grooves are sized as set forth above. Good results have also been obtained when second lip portion 128 is also tapered and its average thickness is slightly greater than the depth of the grooves.

Although this description contains many specifics, these should not be construed as limiting the scope of the invention, but merely as providing illustrations of some of the presently preferred embodiments of the invention. The invention may be utilized to hold workpieces of various shapes that are comprised of various materials for working or for other purposes. Thus, the invention, as described herein, is susceptible to various modifications and adaptations, and the same are intended to be comprehended within the meaning and range of equivalents of the appended claims.

What is claimed is:

1. A method for holding a workpiece having an upper surface, a lower surface and a peripheral edge, which method comprises:

(a) providing a bed that is adapted to support the workpiece, said bed having:

(i) a nonplanar supporting surface so that when the workpiece is supported thereby, a plurality of evacuation spaces are formed between the lower surface of the workpiece and the nonplanar surface of the bed; and (ii) a plurality of vacuum ports that extend through the bed and are in fluid communication with the evacuation spaces so that at least one port communicates with each such space;

(b) adhesively securing a continuous flexible tape to and along the peripheral edge of the workpiece, said tape having a continuous flexible lip portion which curves generally outwardly from the edge of the workpiece;

(c) placing the workpiece with the tape secured thereto on the supporting surface of the bed so as to form a plurality of evacuation spaces between the lower surface of the workpiece and the nonplanar surface of the bed;

(d) blocking or closing vacuum ports in the bed that are located outside the periphery of the workpiece; and (e) pulling a vacuum through the open vacuum ports and evacuation spaces beneath the workpiece so as to hold the workpiece on the bed, whereby the lip portion of the tape will seat on the surface of the bed so as to form a seal between the tape and the surface of the bed at the periphery of the workpiece.

2. The method of claim 1, wherein the flexible tape is secured to and along the peripheral edge of the workpiece before said workpiece is placed on the supporting surface of the bed.

3. A method for holding a workpiece having an upper surface, a lower surface and a peripheral edge, which method comprises:

(a) providing a bed that is adapted to support the workpiece, said bed having:

(i) a nonplanar supporting surface so that when the workpiece is supported thereby, a plurality of evacuation spaces are formed between the lower surface of the workpiece and the nonplanar surface of the bed; and (ii) a plurality of vacuum ports that extend through the bed and are in fluid communication with the evacuation spaces so that at least one port communicates with each space;

(b) securing a continuous flexible tape to and along the peripheral edge of the workpiece, said tape having a continuous, flexible, tapered lip portion which curves generally outwardly from the edge of the workpiece;

(c) placing the workpiece with the tape secured thereto on the supporting surface of the bed so as to form a plurality of evacuation spaces between the lower surface of the workpiece and the nonplanar surface of the bed;

(d) blocking or closing vacuum ports in the bed that are located outside the periphery of the workpiece; and (e) pulling a vacuum through the open vacuum ports and evacuation paces beneath the workpiece so as to hold the workpiece on the bed, whereby the lip portion of the tape will seat on the surface of the bed so as to form a seal between the tape and the surface of the bed at the periphery of the workpiece.

4. The method of claim 1, which includes the step of providing a bed that is adapted to support the workpiece, said bed having a nonplanar supporting surface which includes a plurality of intersecting grooves that are in fluid communication with each other, so that when the workpiece is supported by the bed, a plurality of evacuation spaces are formed between the lower surface of the workpiece and the nonplanar surface of the bed.

5. The method of claim 1, which includes the step of providing a bed that is adapted to support the workpiece, said bed having a nonplanar supporting surface which includes a plurality of intersecting grooves that are in fluid communication with each other, said grooves being arranged in a grid pattern such that adjacent grooves are spaced about four inches apart, so that when the workpiece is supported by the bed, a plurality of evacuation spaces are formed between the lower surface of the workpiece and the nonplanar surface of the bed.

6. The method of claim 1, which includes the step of providing a bed that is adapted to support the workpiece, said bed having a nonplanar supporting surface which includes a plurality of intersecting grooves having a depth that is no greater than the length of the lip portion of the tape, which grooves are in fluid communication with each other, so that when the workpiece is supported thereby, a plurality of evacuation spaces are formed between the lower surface of the workpiece and the nonplanar surface of the bed.

7. The method of claim 1, which includes the step of providing a bed that is adapted to support the workpiece, said bed having a nonplanar supporting surface which includes a plurality of intersecting grooves that are arc-shaped in cross-section, which grooves are in fluid communication with each other, so that when the workpiece is supported thereby, a plurality of evacuation spaces are formed between the lower surface of the workpiece and the nonplanar surface of the bed.

8. The method of claim 1, which includes the step of providing a bed that is adapted to support the workpiece, said bed having a nonplanar supporting surface which includes a plurality of intersecting grooves that are arc-shaped in cross-section, which grooves are in fluid communication with each other, so that when the workpiece is supported thereby, a plurality of evacuation spaces are formed between the lower surface of the workpiece and the nonplanar surface of the bed, and wherein the arc of the grooves is at a diameter of about one inch.

9. A method for holding a workpiece having an upper surface, a lower surface and a peripheral edge, which method comprises:

(a) providing a bed that is adapted to support the workpiece, said bed having:

(i) a nonplanar supporting surface so that when the workpiece is supported thereby, a plurality of evacuation spaces are formed between the lower surface of the workpiece and the nonplanar surface of the bed; and (ii) a plurality of vacuum ports that extend through the bed and are in fluid communication with the evacuation spaces so that at least one port communicates with each space;

(b) securing a continuous flexible tape to and along the peripheral edge of the workpiece, said tape having a pair of continuous flexible lip portions, the first of which curves generally outwardly from the edge of the workpiece and the second of which curves generally inwardly from the edge of the workpiece;

(c) placing the workpiece with the tape secured thereto on the supporting surface of the bed so as to form a plurality of evacuation spaces between the lower surface of the workpiece and the nonplanar surface of the bed, with the second lip portion of the tape being disposed between the workpiece and said supporting surface;

(d) blocking or closing vacuum ports in the bed that are located outside the periphery of the workpiece; and (e) pulling a vacuum through the open vacuum ports and evacuation spaces beneath the workpiece so as to hold the workpiece on the bed, whereby the first lip portion of the tape will seat on the surface of the bed so as to form a seal between the tape and the surface of the bed at the periphery of the workpiece, and the second lip portion will cooperate with the first lip portion to form the seal when a vacuum is pulled.

10. The method of claim 9, wherein the flexible tape is provided with a pair of continuous, flexible tapered lip portions.

11. The method of claim 9, wherein the flexible tape is secured to and along the peripheral edge of the workpiece by means of an adhesive.

12. The method of claim 9, wherein the flexible tape is secured to and along the peripheral edge of the workpiece before said workpiece is placed on the supporting surface of the bed.

13. The method of claim 9, wherein the nonplanar surface of the bed is provided with a plurality of intersecting grooves that are in fluid communication with each other.

14. The method of claim 13, wherein the nonplanar surface of the bed is provided with grooves that are arranged in a grid pattern such that adjacent grooves are spaced about four inches apart.

15. The method of claim 13, wherein the nonplanar surface of the bed is provided with grooves, the depth of which is no greater than the length of the first lip portion of the tape.

16. The method of claim 13, wherein the flexible tape is provided with a second lip portion having an average thickness that is slightly greater than the depth of the grooves.

17. The method of claim 13, wherein the nonplanar surface of the bed is provided with grooves that are arc-shaped in cross-section.

18. The method of claim 17, wherein the nonplanar surface of the bed is provided with grooves that are arc-shaped in cross-section, and wherein the arc of the grooves is at a diameter of about one inch.

* * * * *